US005305690A

United States Patent [19]

Abumehdi

[11] Patent Number: 5,305,690

[45] Date of Patent: Apr. 26, 1994

[54] FRANKING MACHINE WITH CARRIAGE MOUNTED RESILIENT PRESSURE ROLLER

[75] Inventor: Cyrus Abumehdi, Harlow, United Kingdom

[73] Assignee: Neopost Limited, Essex, United Kingdom

[21] Appl. No.: 993,850

[22] Filed: Dec. 21, 1992

[30] Foreign Application Priority Data

Dec. 30, 1991 [GB] United Kingdom ..... 9127479

[51] Int. Cl.[5] ..... B41F 3/04

[52] U.S. Cl. ..... 101/269; 400/56

[58] Field of Search ..... 101/269, 270, 252, 260, 101/264, 45, 91, 212, 214, 232; 400/56, 58

[56] References Cited

U.S. PATENT DOCUMENTS 2,043,056 6/1936 Mueller ..... 101/269
2,375,793 5/1945 Kidrick et al. ..... 101/269
3,098,435 7/1963 Flower et al. ..... 101/269
3,804,014 4/1974 Thiene ..... 101/269
4,461,212 7/1984 Geney ..... 101/232
4,705,413 11/1987 Arnoldi ..... 101/232

*Primary Examiner*—Eugene H. Eickholt
*Attorney, Agent, or Firm*—Shoemaker and Mattare Ltd.

[57] ABSTRACT

A franking machine is disclosed comprising a carriage manually movable along a bed and a print drum carried by the carriage to make rolling engagement with a mail item supported on the bed. A toothed rack extends along the length of the bed and gearing on the carriage meshes with the rack to drive the print drum and an impression roller carried by the carriage. The gearing is arranged such that as the carriage is moved in a forward direction along the bed, a mail item gripped between the print drum and the impression roller is fed along the bed in the reverse direction so that the length of traverse of the carriage, and the length of the bed, is less than the length of the franking impression to be printed.

7 Claims, 2 Drawing Sheets

FRANKING MACHINE WITH CARRIAGE MOUNTED RESILIENT PRESSURE ROLLER

BACKGROUND OF THE INVENTION

This invention relates to franking machines which are used to impress a franking impression on mail items.

Known franking machines comprise a postage meter supported on a base in which the postage meter includes a print drum for printing franking impressions on mail items and electronic circuits for carrying out accounting and control functions in relation to operation of the postage meter. The print drum carries a printing die for printing an invariable pattern of a franking impression and a set of print wheels having type characters on their peripheries. Mechanisms are provided for setting the print wheels so as to print a required value of postage charge in the franking impression. The print wheel setting mechanisms are controlled by the electronic accounting and control circuits and the accounting circuits maintain accounting records which are updated during each franking operation to take into account the value of postage used. An electric drive motor is located in the base of the machine and drive from the motor is mechanically coupled to the print drum to cause rotation thereof through a single revolution in each franking operation.

Such franking machines have complex mechanisms and this together with the power drive to the print drum results in the franking machines being relatively costly to manufacture. Furthermore the motor drive results in the machine being heavy.

SUMMARY OF THE INVENTION

According to the invention a franking machine includes a base member; a carriage movable from a home position to a &inal position along the base member; a rotatable print drum carried by the carriage; and drive transmission means interconnecting the carriage and the base member to cause rotation of the print drum through a franking impression printing revolution in response to movement of the carriage away from the home position to said final position in a franking printing operation.

BRIEF DESCRIPTION OF THE DRAWING

An embodiment of the invention will now be described by way of example with reference to the drawings in which.

DESCRIPTION OF THE PREFERRED EMBODIMENT

Figure 1:
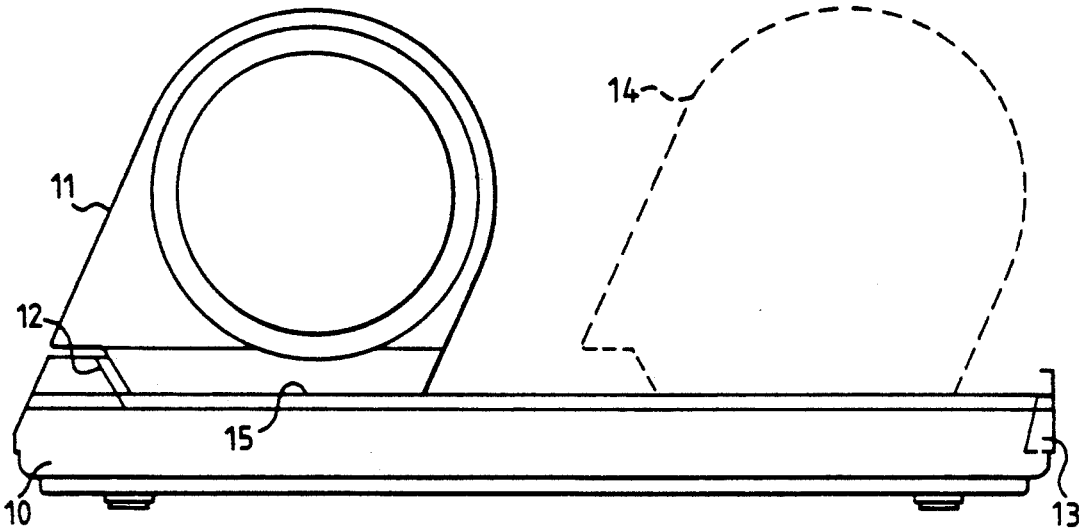
FIG. 1 is a front elevation of the franking machine.
Figure 2:
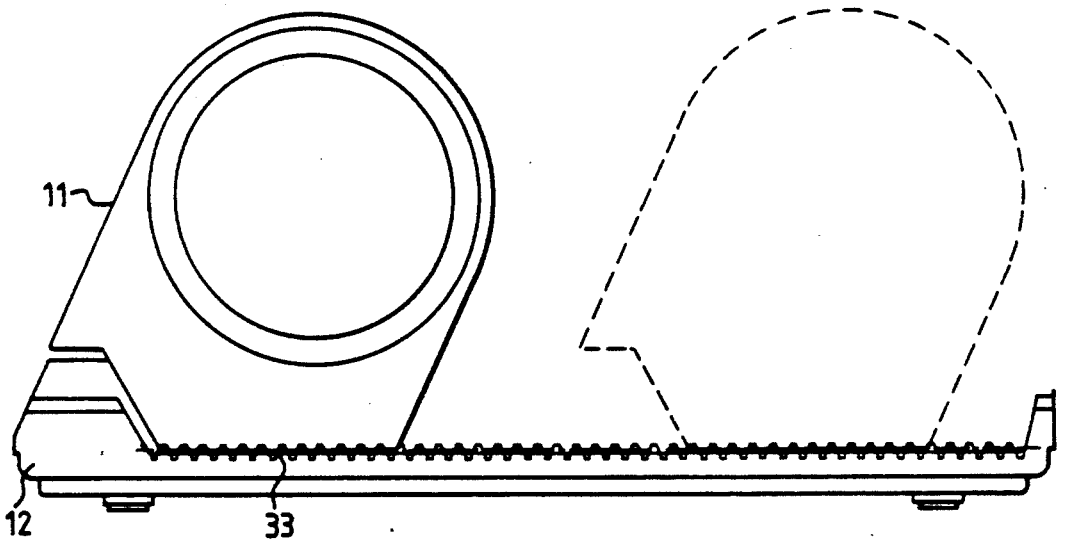
FIG. 2 is a longitudinal sectional view.

Referring first to FIG. 1, a franking machine comprises a base 10 and a carriage 11 manually movable along the length of the base between end stops 12 and 13. The carriage is shown in a normal inoperative position adjacent the end stop 12 and an intermediate position through which the carriage passes in operation of the machine is indicated by dotted line outline 14. A bed 15 for supporting a mail item extends lengthwise of the base 10 and as the carriage is moved from its inoperative position to the other end of the machine, a print drum in the carriage makes rolling engagement with the face of the mail item to impress a franking impression on the mail item.

Figure 3:
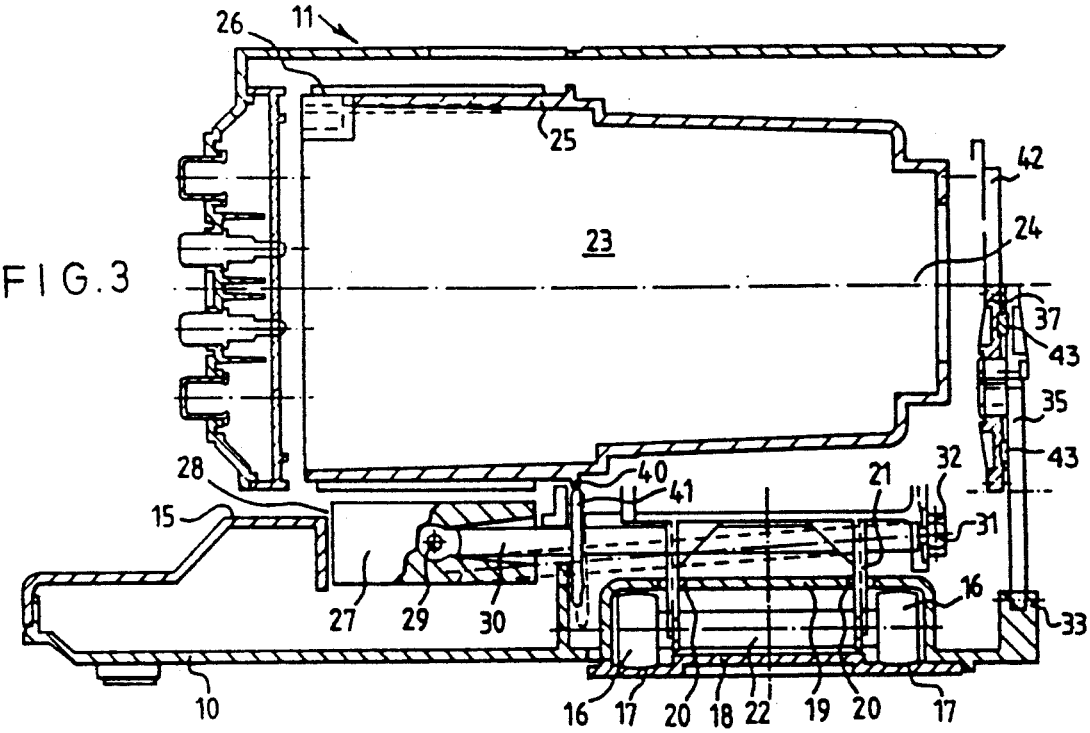
FIG. 3 is a transverse sectional view.

Referring now to FIG. 3, the carriage is supported by means of two pairs of rollers 16 which run on elongate parallel tracks 17 formed on a plate 18 secured to the base. The base is formed with an inverted channel 19 extending over the plate 18. A pair of parallel slots 20 extend along the channel and legs 21 of the carriage extend through the slots. The pairs of rollers 16 are freely rotatable on the ends of shafts 22 secured to the legs 21. Thus the carriage is supported for lengthwise movement relative to the base 10 by means of the rollers running on the tracks 17 and the carriage is held captive on the base due to the inverted channel extending over the rollers.

A rotatable drum member 23 is mounted for rotation about an axis 24 by bearing means (not shown) on the carriage 11. One end of the drum member is formed as a print drum 25 extending over the bed 15. The print drum 25 carries a printing die 26 for printing an invariable pattern of a franking impression. Mounted within the drum and extending through an aperture in the wall of the drum and a corresponding aperture in the printing die are a plurality of printing wheels (not shown). The printing wheels have type characters on the peripheries thereof and the wheels can be set by rotation of the wheels in the drum to bring a desired character on each wheel into a printing position in which it lies aligned with the curved surface of the printing die. One set of wheels is provided for printing of a postage value and another set is provided for printing a date in the franking impression.

An impression roller 27 is mounted on the carriage to extend through an elongate aperture 28 in the bed 15 in opposition to the printing die 26 on the print drum 25. The impression roller is secured by a ball and socket joint 29 on one end of a rotatable shaft 30. The other end of the shaft is mounted by means of a ball and socket joint 31 to a pulley 32 rotatably mounted on the carriage 11. The shaft 30 is constrained to pivotal movement about the joint 31 in a vertical direction so that the impression roller is free to move toward and away from the print drum. Resilient means (not shown) act on the impression roller to urge it toward the print drum and thereby apply an impression force to the rear face of a mail item on the feed bed.

Figure 4:
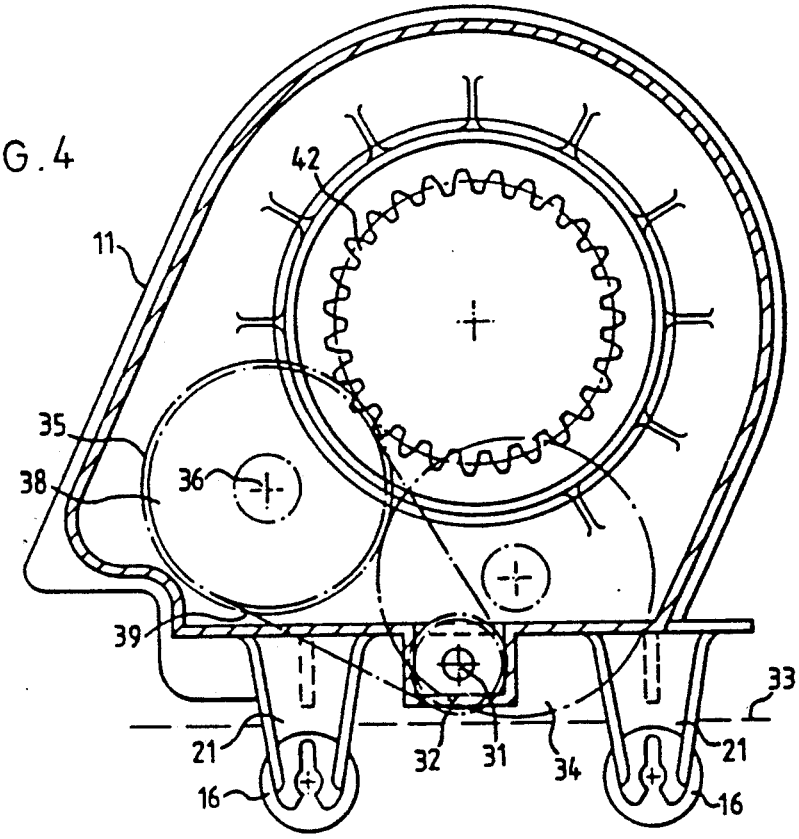
FIG. 4 illustrates a drive train for a print drum of the machine.

A rotational drive force is applied to the drum member to cause the drum member to rotate, with the printing die in engagement with a mail item, when the carriage is moved from its inoperative position adjacent end stop 12 to the opposite end of the base 10. As shown in FIG. 4, the rotational drive force is derived from a gear train engaging a rack 33 extending along the base 10. The gear train comprises a first toothed pinion 34 mounted for rolling engagement with the rack 33, a second toothed pinion 35 rotatable about an axis 36 and meshing with the first pinion, a third toothed pinion 37 rotatable about the axis 36, and a fourth toothed pinion 42 mounted on the drum member 23 and meshing with the third pinion 37. A one way clutch mechanism 43 provides a drive coupling between the second pinion 35 and the third pinion 37 whereby drive is transmitted to the drum member during movement of the carriage away from end stop 12 but is not transmitted to the drum member during return movement of the carriage to its inoperative position adjacent end stop 12. A pulley 38 is secured to and rotatable with the third pinion 37 and a toothed belt 39 passes around pulley 38 and the pulley 32 on the impression roller shaft 30 to transmit rotational drive to the impression roller. The drive to the impression roller is arranged such that the peripheral motion of the impression roller is matched to that of the print die.

A cam 40 extending around the drum member engages a circular cam follower 41 on the shaft 30 of the impression roller. The cam is so shaped as to move the impression roller, against the force of the resilient means, away from the print die when the drum member is in a non-printing home position in which the die is angularly spaced from the bed 15. The angular rotational position of the drum member about the axis 24 relative to the carriage is so arranged that the drum member in the non-printing home position when the carriage is in the non-operational home position adjacent the end stop 12.

It will be appreciated that, as is well known in the franking machine art, the franking machine is provided with electronic accounting and control circuits which carry out accounting operations in relation to funding of the machine with credit and decrementing of the credit as postage value is used in franking of mail items. Postage value selection means are provided to enter a value of postage charge with which it is desired to frank a mail item and in response to this value selection means a mechanism is operated to set the print wheels to print the desired value and the accounting means carries out accounting operations to update accounting data in respect of the desired value of postage charge. Conveniently the value selection means and the accounting and control circuits may be contained within the drum member. One form of user operated value selection means indicated in FIG. 3 comprises a set of push buttons which operate mechanisms coupled to print wheel setting mechanisms and to encoder devices for generating electrical signals representing the selected value for input to the accounting circuits. A display may be provided on the drum member which is controlled by the accounting and control circuits to display accounting data and information assisting use of the machine by a user. The display is located at a position on the drum member such that it is visible when the drum member is in its non-printing home position and may be obscured during rotation of the drum member in a printing cycle. Preferably with the electronic circuits housed in the rotatable drum member, the circuits are powered by long life batteries to avoid any necessity for slip ring electrical connections to the drum member.

When the franking machine is non-operational, the carriage is in the home position adjacent end stop 12, the print drum is in the non-printing home position and a latch retains the print drum in its home position. When it is desired to frank a mail item, the item is positioned on the bed 15 with one end of the item abutting the end stop 13 and the item extending along the bed and between the print drum and the impression roller, the impression roller being spaced by the action of the cam from the print drum. After selecting the required value of postage charge and response thereto by the electronic accounting and control circuits, the circuits release the latch retaining the drum member to permit rotation of the print drum. The user then moves the carriage along the base and this causes the drum member and impression roller to be rotated due to the action of the rack and gear train. The rotation of the cam permits the impression roller to move toward the print drum and apply pressure to the rear face of the mail item in the nip between the roller and the print drum. As a result the print die and print wheels, which are inked by means (not shown) make rolling engagement with the mail item in the nip therebetween. As the print die and wheels roll along the mail item the impression roller urges the face of the mail item into printing engagement with the die and wheels to cause a franking impression to be imprinted on the mail item. When the carriage reaches the end of the base remote from its home position, the drum member will have been rotated through one revolution and hence the drum will have rotated to its non-printing home position. A latch then prevents further rotation of the drum member. In the non-printing home position of the drum member, the impression roller is held spaced from the print drum and hence when the carriage reaches the end of its travel and the drum member reaches its home position, the mail item is released and may be removed by the user. The user then returns the carriage to the non-operational home position ready for the next franking operation.

As hereinbefore described the mail item is stationary on the bed during movement of the carriage to effect printing of the franking impression. Accordingly, the length of the franking machine needs to be sufficient to permit the printing of the full length of a franking impression together with any required advertising logo. However if desired the length of the franking machine may be decreased while still permitting printing of the same length of franking impression and advertising logo by feeding the mail item in a reverse direction to that of the carriage during the printing operation. This is accomplished by arranging that the gear ratios of the pinions of the gear train are such that during forward movement of the carriage away from its home position, the peripheries of the print die and the impression roller have a resultant rearward velocity. As a result as the carriage is moved forwards away from the home position thereof, the mail item gripped between the print die and the impression roller is moved rearwardly in the opposite direction.

I claim:

1. A franking machine including a base member; a carriage movable from a home position to a final position along the base member; a rotatable print drum carried by the carriage; drive transmission means interconnecting the carriage and the base member to cause rotation of the print drum through a franking impression printing revolution in response to movement of the carriage away from the home position to said &inal position in a franking printing operation; and an impression roller mounted on said carriage and resiliently urged toward said print drum to apply impression pressure to a mail item located between said print drum and said impression roller.

2. A franking machine as claimed in claim 1 wherein the drive transmission means includes one way clutch means operative to transmit drive to the print drum during movement of the carriage in a direction away from the home position and inoperative to transmit drive to the print drum during movement of the carriage in a reverse direction toward the home position.

3. A franking machine including a base member; a carriage movable from a home position to a final position along the base member; a rotatable print drum carried by the carriage; drive transmission means interconnecting the carriage and the base member to cause rotation of the print drum through a franking impression printing revolution in response to movement of the carriage away from the home position to said final position in a franking printing operation; said drive transmission means including a toothed rack extending along the base parallel to movement of the carriage and a toothed pinion on said carriage mechanically coupled to the print drum and in meshing engagement with said rack; and an impression roller mounted on said carriage and resiliently urged toward said print drum to apply impression pressure to a mail item located between said print drum and said impression roller.

4. A franking machine as claimed in claim 3 wherein the drive transmission means is coupled to the impression roller to cause rotation thereof such that peripheral motion of said impression roller is matched to that of the print drum.

5. A franking machine as claimed in claim 3 wherein the drive transmission means rotates the print drum such that the periphery of the print drum opposed to the impression roller has a resultant movement in a reverse direction relative to the carriage during forward movement of the carriage away from the home position.

6. A franking machine as claimed in claim 5 wherein the drive transmission means is coupled to the impression roller to cause rotation thereof such that peripheral motion of said impression roller is matched to that of the print drum.

7. A franking machine as claimed in claim 3 wherein the drive transmission means includes one way clutch means operative to transmit drive to the print drum during movement of the carriage in a direction away from the home position and inoperative to transmit drive to the print drum during movement of the carriage in a reverse direction toward the home position.

* * * * *